US006318706B1

(12) United States Patent
Montaz

(10) Patent No.: US 6,318,706 B1
(45) Date of Patent: Nov. 20, 2001

(54) DEVICE FOR COMPRESSING A COMPRESSIBLE FLUID

(76) Inventor: Edmond Montaz, 45 Blvd. Carnot, 78110 Le Vesinet (FR)

( * ) Notice: Subject to any disclaimer, the term of this patent is extended or adjusted under 35 U.S.C. 154(b) by 0 days.

(21) Appl. No.: 09/445,064

(22) PCT Filed: Jun. 2, 1998

(86) PCT No.: PCT/FR98/01103

§ 371 Date: Dec. 1, 1999

§ 102(e) Date: Dec. 1, 1999

(87) PCT Pub. No.: WO98/55808

PCT Pub. Date: Dec. 10, 1998

(30) Foreign Application Priority Data

Jun. 2, 1997 (FR) ..... 97 06734

(51) Int. Cl.[7] ..... B01F 3/04

(52) U.S. Cl. ..... 261/115; 261/DIG. 15; 239/533.13; 239/546

(58) Field of Search ..... 261/115, DIG. 15, 261/DIG. 68; 239/101, 132.1, 265.43, 533.13, 546, DIG. 12

(56) References Cited

U.S. PATENT DOCUMENTS

| | | | | |
|---|---|---|---|---|
| 2,546,293 | * | 3/1951 | Berliner | 239/546 |
| 2,959,359 | | 11/1960 | Casaletto | 239/533.13 |
| 2,986,002 | * | 5/1961 | Ferri | 239/533.13 |
| 3,143,293 | * | 8/1964 | Purse | 239/546 |
| 3,427,006 | * | 2/1969 | Oiestad | 261/115 |
| 3,473,738 | * | 10/1969 | De Mattos | 239/546 |
| 3,498,541 | * | 3/1970 | Taylor, Jr. et al. | 239/546 |
| 3,776,470 | | 12/1973 | Tsuchiya | 239/546 |
| 3,848,799 | | 11/1974 | Day . | |
| 4,789,104 | * | 12/1988 | Anderson | 239/546 |

FOREIGN PATENT DOCUMENTS

3644590 A1 7/1988 (DE) .

OTHER PUBLICATIONS

Translation of PCT International Preliminary Examination Report (previously furnished in French).
International Preliminary Examination Report dated Aug. 11, 1999.
International Search Report dated Sep. 30, 1998.

* cited by examiner

*Primary Examiner*—C. Scott Bushey
(74) *Attorney, Agent, or Firm*—Cohen, Pontani, Lieberman & Pavane

(57) ABSTRACT

A circularly symmeterical casing is deformable between a maximum flow section and a minimum flow section, making it possible to increase the pressure of the air passing through casing from a minimum pressure for the maximum flow section to a maximum pressure for the minimum flow section. The invention makes it possible to obtain a fluid jet of substantially constant range.

21 Claims, 6 Drawing Sheets

DEVICE FOR COMPRESSING A COMPRESSIBLE FLUID

PRIOR ART

Numerous prior art air compressor devices are known. Most are complex and require high energy consumption.

In addition, in the context of regulating temperature in a room by means of a flow of air, prior devices are generally based on the use of a mixture of air flows at different temperatures for adjusting the temperature to the desired temperature, at constant pressure.

Thus, for example, Document DE-A-36 44 590 describes, in particular with reference to FIGS. 12 to 14, an embodiment of apparatus for air-conditioning a room and comprising an induction air diffuser 55 whose flow rate can be varied by a device 57 for closing its outlet opening 21 in part. That apparatus achieves a flow rate variation but does so by using the same pressure as the intake pressure. It is thus a conventional system in which the outlet pressure is essentially identical to the intake pressure, and, from complete opening to complete closure, the outlet pressure of the air remains unchanged so that the length of the air jet varies as a function of the value of the working outlet opening 21.

Document U.S. 2,959,359 relates to an adjustable flow rate nozzle that operates on the same principle, and is described in particular for spraying liquids.

Document U.S. 3,776,470 describes a nozzle device of variable flow section for conveying various fluids that can contain solid particles which can be carried away by the flow of fluid. That device operates on the same principle as in the preceding documents, without any upstream obstruction device, since that would prevent the flow, specifically of the solid particles that can be carried away by the fluid.

OBJECTS OF THE INVENTION

A main object of the present invention is to solve the new technical problem consisting in providing a solution that makes it possible to compress a compressible fluid (preferably air) to a variable pressure in a manner that is particularly simple, and low cost, starting from an incident flow whose pressure is substantially constant.

Another main object of the invention is to solve the new technical problem consisting in providing a solution that makes it possible to form a fluid jet of substantially constant range, this flow of fluid advantageously being air, thereby making it possible to provide apparatus for air-conditioning at least one room.

Another main object of the present invention is to solve the new technical problem consisting in providing a solution that makes it possible to compress a compressible fluid (preferably air) with its flow rate being self-regulating or automatically compensated, thereby removing the need for pipes, pumps, heat-exchanger batteries for cooling or heating, since it is then possible for all the necessary power to be transmitted directly to the fluid, thereby also making it possible to obtain comfort that is unparalleled in the context of air-conditioning. In addition, an object of the invention is to make it possible to compress a compressible fluid (preferably air) that is flowing at a high speed, thereby making it possible to implement variants of the invention so that it can be used in all sectors of air-conditioning, ranging, for example, from use in an offshore platform to use in the home, thereby opening up new market sectors, in particular by means of implementation costs that are particularly low compared with the costs of the prior art product(s) on the market.

An object of the present invention is to solve these new technical problems in a manner that is simple, low-cost, reliable, and usable on an industrial scale and in the context of air-conditioning business premises or dwellings.

The present invention achieves all of these results simultaneously.

DETAILED DESCRIPTION OF THE INVENTION

In a first aspect, the present invention provides apparatus making it possible to obtain a fluid jet that is preferably of constant range, said apparatus being characterized in that it comprises a confinement duct for confining said fluid, which duct is open at both of its ends, namely its upstream end and its downstream end, and is provided at its downstream end with at least one compressor device for compressing said compressible fluid, which device comprises a deformable casing that is deformable between a maximum flow section and a minimum flow section, and, at its upstream end, said duct is provided with at least one member organized to adjust the head loss of the incoming fluid, thus making it possible to increase the pressure of the air passing through the casing from a minimum pressure for the maximum flow section to a maximum pressure for the minimum flow section, thereby providing a pressure in the fluid at the outlet of the apparatus that is variable starting from an incident flow of substantially constant pressure.

In other words, the invention makes it possible to transfer energy from the upstream portion to the downstream portion by means of the presence of at least one member organized to adjust the head loss of the incoming flow. It can be understood that when the downstream flow section is at its maximum, the flow rate is at its maximum and the head loss is at its maximum, so that the pressure of the fluid output by the apparatus of the invention is at its minimum, i.e. very different from the pressure of the incoming flow, whereas when the flow section is almost closed, the outgoing flow rate is at its minimum, so that the head loss in the device for adjusting head loss tends towards zero, thereby transferring pressure from the head-loss device to the outlet of the apparatus, and the outlet pressure is then at its maximum.

It is thus possible to construct apparatus which, for example, for a 50% reduction in flow rate, maintains a downstream flow rate that remains unchanged (which is quite surprising and remarkable).

In another advantageous embodiment of the invention, said apparatus is characterized in that the device as a whole is an assembly in alignment on an axis, i.e. the upstream head-loss member has its axis essentially aligned with the axis of the downstream compressor device, and also preferably with the axis of an optional confinement duct for confining the fluid, so that maximum energy recovery can be obtained with minimum turbulence in the apparatus and at the outlet thereof, thereby minimizing noise, the apparatus preferably being constructed with an internal duct profile at an air-flow angle that is substantially perfect, and generally about 7°.

In a currently-preferred embodiment, the member for adjusting a said head loss comprises at least one cylinder subdivided into a multitude of tubes of predetermined diameter for passing said fluid, thereby making it possible to obtain head loss that is predetermined, while making said device more flexible for varying the downstream pressure.

In an advantageous variant embodiment, the apparatus is characterized in that, upstream, it comprises a plurality of head-loss members that can be plugged into one another, so as to increase the total length of the tubes, thus causing head loss to vary, thereby influencing the value of the pressure of the fluid at the outlet of the apparatus.

In another advantageous embodiment of the apparatus, at least one partial-closure member is provided, advantageously upstream from said member for adjusting the head loss of the incoming fluid, which partial-closure member can be moved inactively, partially actively, or fully actively, by being moved towards or away from the member for adjusting head loss, so as to provide fine head-loss adjustment.

In an advantageous embodiment, the device is characterized in that said casing is circularly-symmetrical in shape, and its maximum flow section is a substantially cylindrical section. Advantageously, the minimum flow section of the deformable casing is an essentially flattened section.

In another embodiment, the device is characterized in that it comprises means for varying the section of said deformable casing.

In a variant embodiment, the means for varying the section of said casing are controlled by a control member outside the casing, which member does not interfere with the flow section of the deformable casing.

Advantageously, said deformable casing comprises a diaphragm which, in the non-deformed state, is essentially cylindrical in shape, and which is made, for example, of rubber, of elastomer, of a thin metal or of a fine blade, or of similar materials.

In a particularly advantageous embodiment, the means for varying the section of said deformable casing comprise at least two flattening elements disposed substantially diametrically opposite about the axis of symmetry of said circularly-symmetrical casing.

In an advantageous variant embodiment, each of said two elements comprises a substantially plane blade mounted to rotate about a pin substantially perpendicular to the axis of symmetry of said circularly-symmetrical casing, said pin being disposed outside the maximum flow section of the casing.

In a particular variant embodiment, at their fluid outlet free ends, the two substantially plane blades comprise at least two wedge-forming elements of predetermined thicknesses and disposed diametrically opposite about said circularly-symmetrical casing, so that, at the end of the stroke, they close the circularly-symmetrical casing in its central portion, while leaving two open zones offset from the axis of symmetry so as to obtain a fluid flow rate at a maximum pressure.

In another advantageous embodiment of the invention, said deformable casing is of predetermined length which may, advantageously be about twice its diameter.

Naturally, said compressible fluid is generally a gas and advantageously air, which makes it possible to consider using said device in the context of apparatus making it possible to obtain a fluid jet of substantially constant range, as well as in the context of air-conditioning at least one room, as described below with reference to the second aspect of the invention.

In a second aspect, the present invention also covers apparatus making it possible to obtain a fluid jet that is preferably of substantially constant range, said apparatus being characterized in that it comprises a confinement duct for confining said fluid, which duct is open at both of its ends, namely its upstream end and its downstream end, and is provided at its downstream end with at least one compressor device as defined above.

In another advantageous embodiment of the apparatus of the invention, said apparatus is characterized in that said confinement duct has an inside surface of diameter tapering from upstream to downstream, so as to increase the speed at which the fluid flows.

In a particularly-advantageous application of the invention, said apparatus is organized for air-conditioning at least one room, and is characterized in that it further comprises an injection system for injecting a fluid at a predetermined temperature for correcting the temperature or the humidity of said room.

In a particularly advantageous variant embodiment, said injection system is disposed in the vicinity of the downstream outlet of said fluid, preferably in a manner offset relative to the axis of said circularly-symmetrical casing. In a variant, the system may be disposed outside said confinement pipe.

In another advantageous embodiment, the apparatus of the invention is characterized in that the injection system comprises an additional fluid injection pipe for injecting additional fluid and whose diameter is approximately in the range two to four times smaller than the diameter of said casing in the non-deformed state.

In another embodiment of the invention, said injection system is disposed inside said confinement piping, in the vicinity of its upstream end.

In another advantageous embodiment of the invention, said confinement piping is itself disposed inside fluid feed ducting for feeding fluid to said room.

According to another advantageous characteristic of the invention, the apparatus is characterized in that said confinement piping is disposed inside said ducting in the vicinity of a fluid intake inlet for taking in fluid from said room, said intake preferably being performed by external mechanical means, such as a fan.

In a currently-preferred embodiment, the apparatus is characterized in that said fluid is constituted by air, and said at least one room belongs to business premises or to a dwelling.

By means of the invention, it is possible to adjust the outlet pressure of the fluid (such as air) output by the compressor device, thereby making it possible to obtain a fluid jet that is of substantially constant range, without modifying the pressure of the incoming fluid, and thus to air-condition at least one room under ideal conditions that are economical with energy, with a structure that is extremely simple, and much less costly than prior devices used for air-conditioning rooms.

Other objects, characteristics, and advantages of the invention appear clearly to the person skilled in the art from the following explanatory description made with reference to the accompanying figures which are given merely by way of illustration, and therefore do not limit the scope of the invention in any way. It should be noted that the figures are integral parts of the invention and thus of the present description. In addition, any characteristic that turns out to be novel compared with any of the prior art is part of the invention in its most general terms, as can be well understood by the person skilled in the art.

Figure 1:
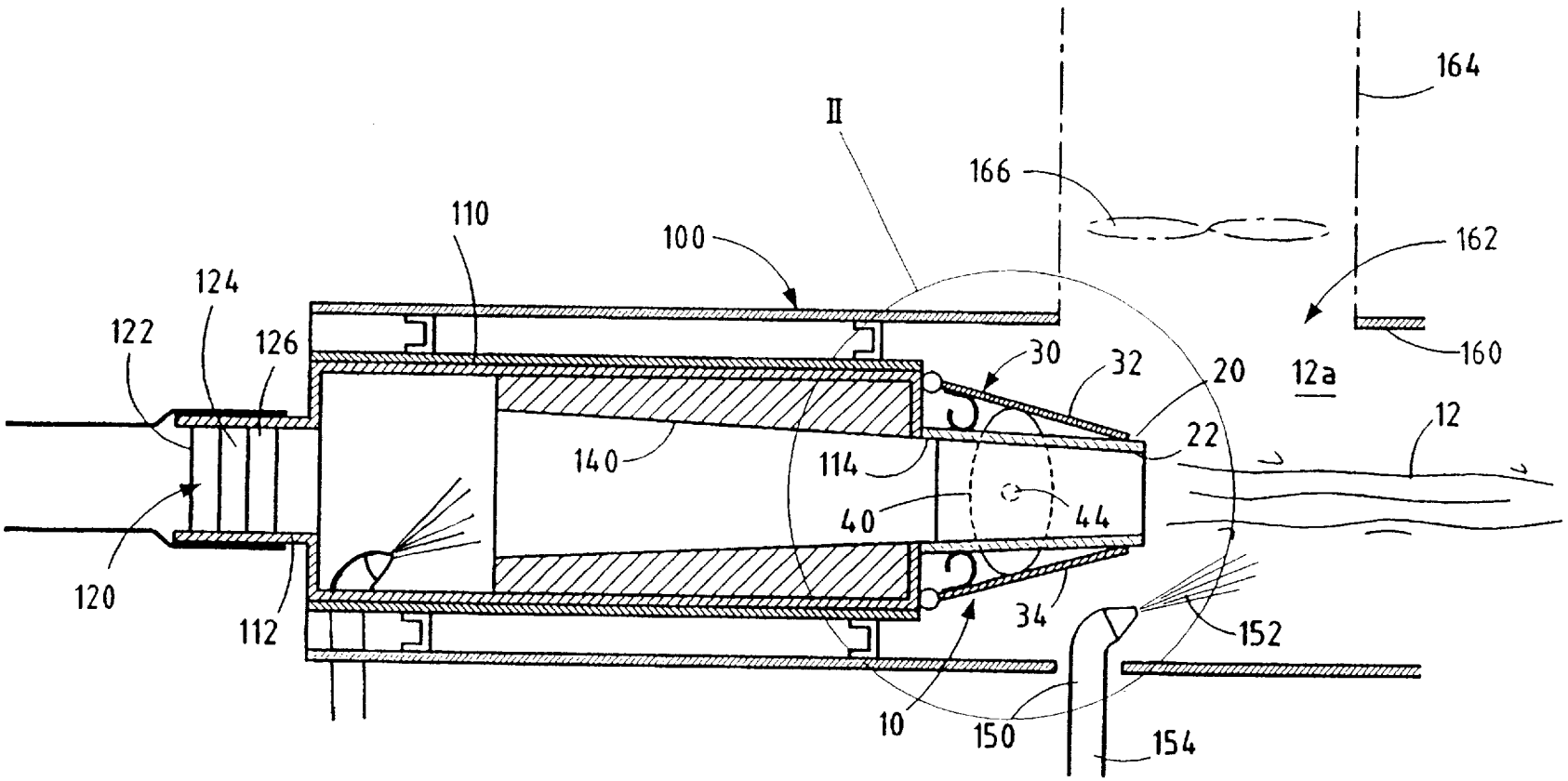
FIG. 1 is a diagrammatic longitudinal section view of a device of the invention for compressing a compressible fluid such as air, which device comprises a downstream deformable casing and an upstream head-loss member, and is incorporated in apparatus making it possible to obtain a fluid jet of substantially constant range, the device as a whole being an assembly in alignment on an axis.
Figure 4:
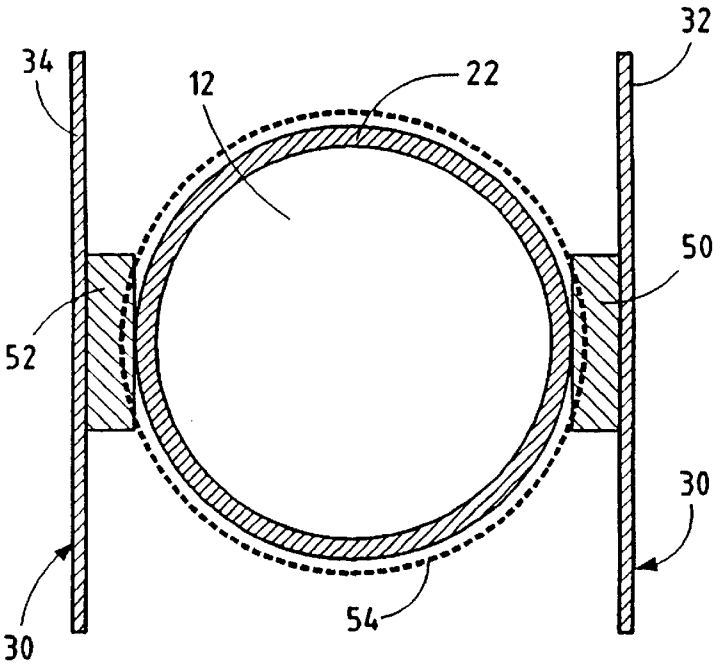
FIG. 4 is also a downstream view looking along arrow III of FIG. 2, when the device is in the maximum flow section position.
Figure 5:
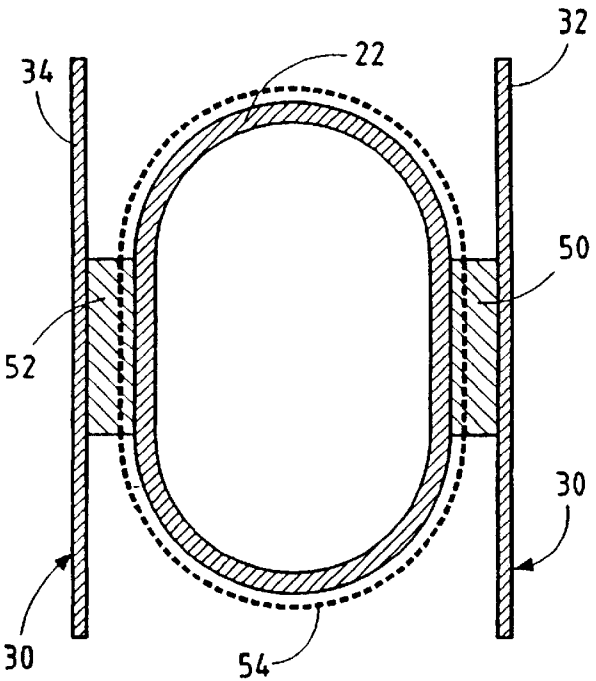
FIG. 5 is a view similar to the FIG. 4 view, when the device is in an intermediate position.
Figure 6:
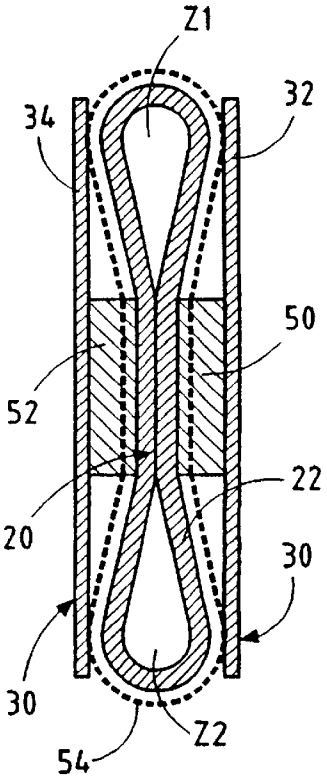
FIG. 6 is a view similar to views in FIGS. 4 and 5, when the device is in the minimum flow section position.
Figure 7:
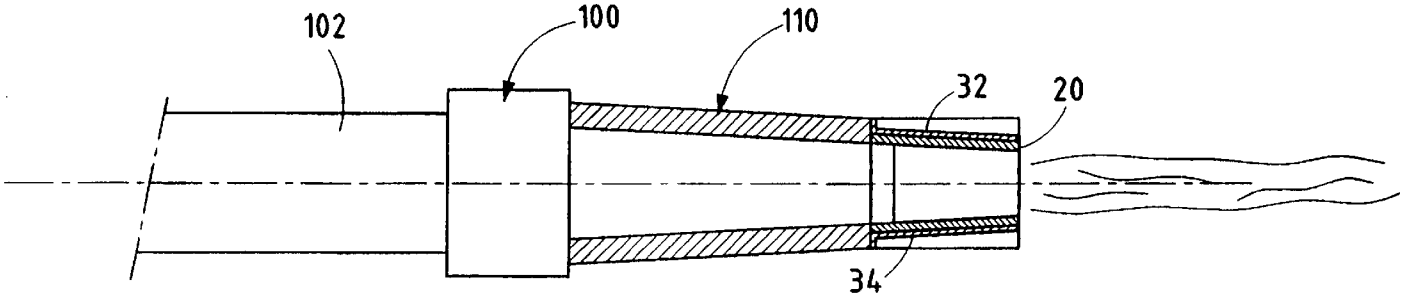
Figure 8:
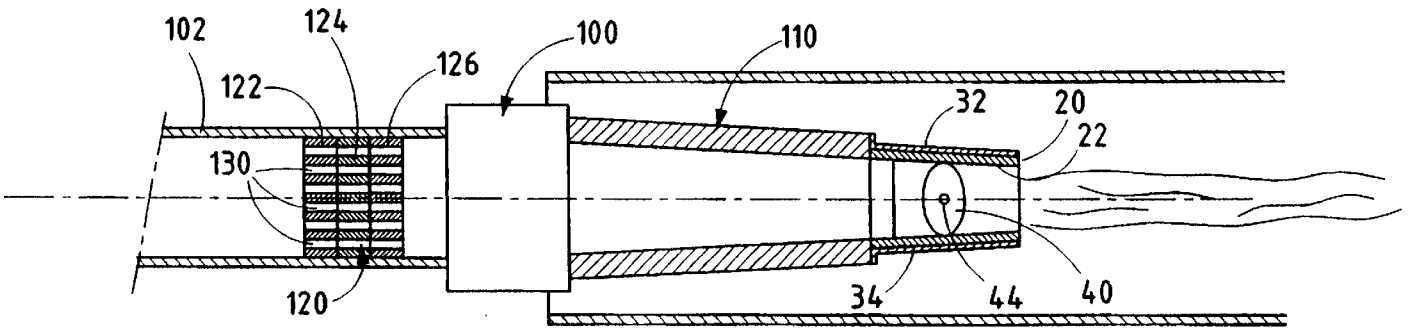
Figure 9:
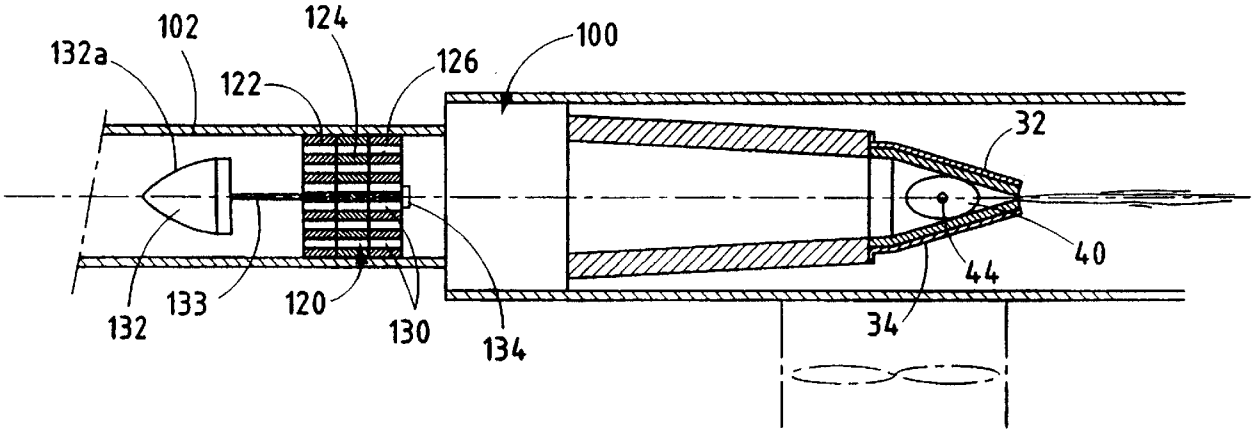
Figure 10:
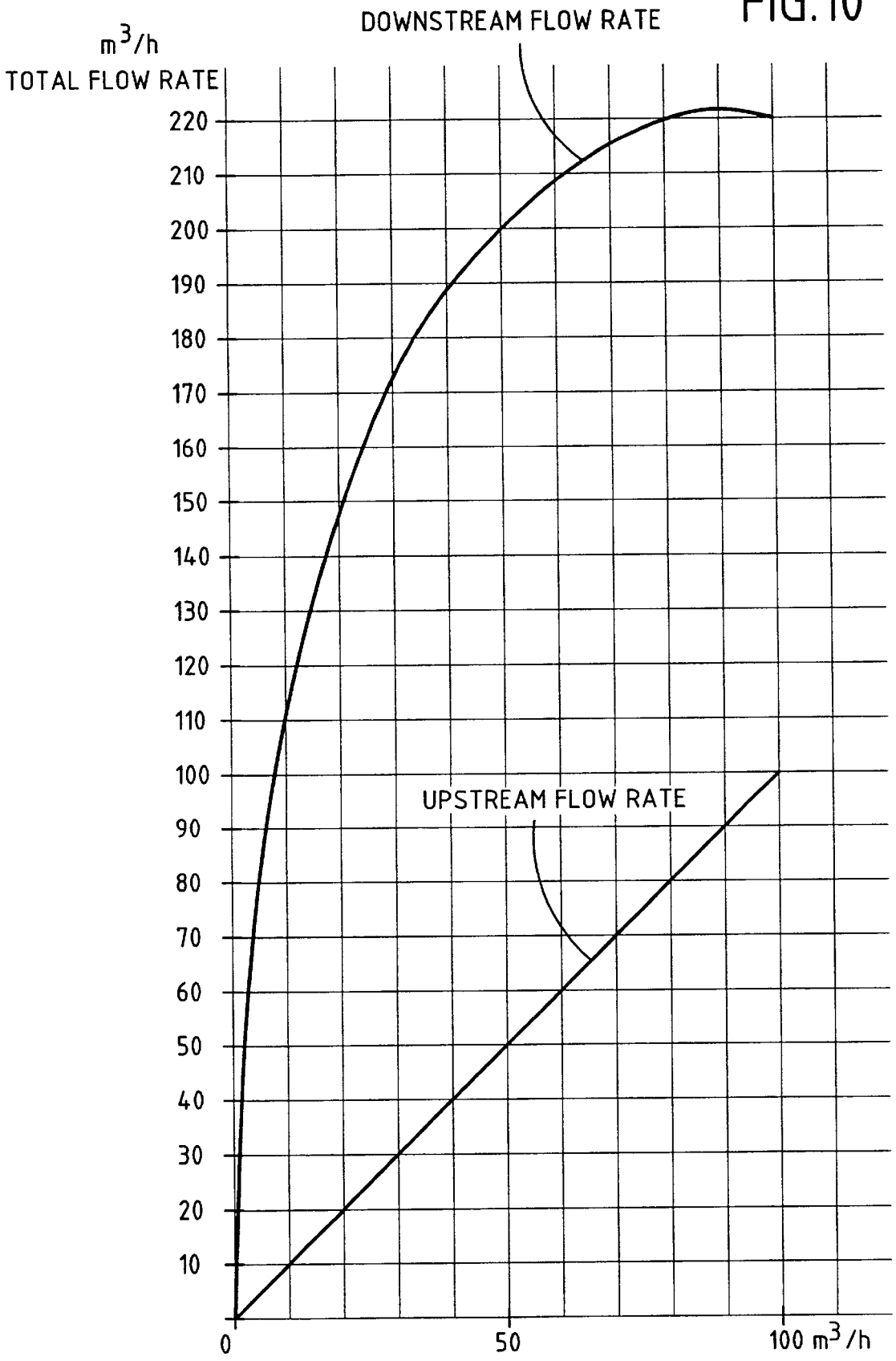

FIGS. 7, 8, and 9 are diagrammatic views similar to the view in FIG. 1, for each position, respectively the maximum flow section position (FIG. 7), the intermediate flow section position (FIG. 8), and the minimum flow section position (FIG. 9), which positions correspond respectively to the flow section positions of FIGS. 4, 5, and 6;

FIG. 9 shows a variant in which a member for closing off in part the active section of the head-loss member is advantageously present; and FIG. 10 is a graph of the upstream flow rate curve and of the downstream flow rate curve respectively obtained by means of the compressor device of the present invention, it being possible to observe that, with the upstream flow rate being constant, the downstream flow rate can be adjusted over quite a wide range, which can also be well understood by the person skilled in the art, and which can also be understood with reference to the following description of the figures.

FIG. 1 is a longitudinal section view of a device, given overall reference 10, for compressing a compressible fluid 12, which device is, in this example, incorporated in apparatus represented by overall reference 100 and making it possible to obtain a fluid jet of substantially constant range, by means of a variable outlet pressure being generated from an incident flow of substantially constant pressure, the pressure being varied by means of the presence of at least one head-loss adjustment member 120 disposed upstream and described in more detail below. Furthermore, it should be noted that, in the context of the invention, the various devices or members of the apparatus 100 are essentially in alignment on an axis.

Figure 2:
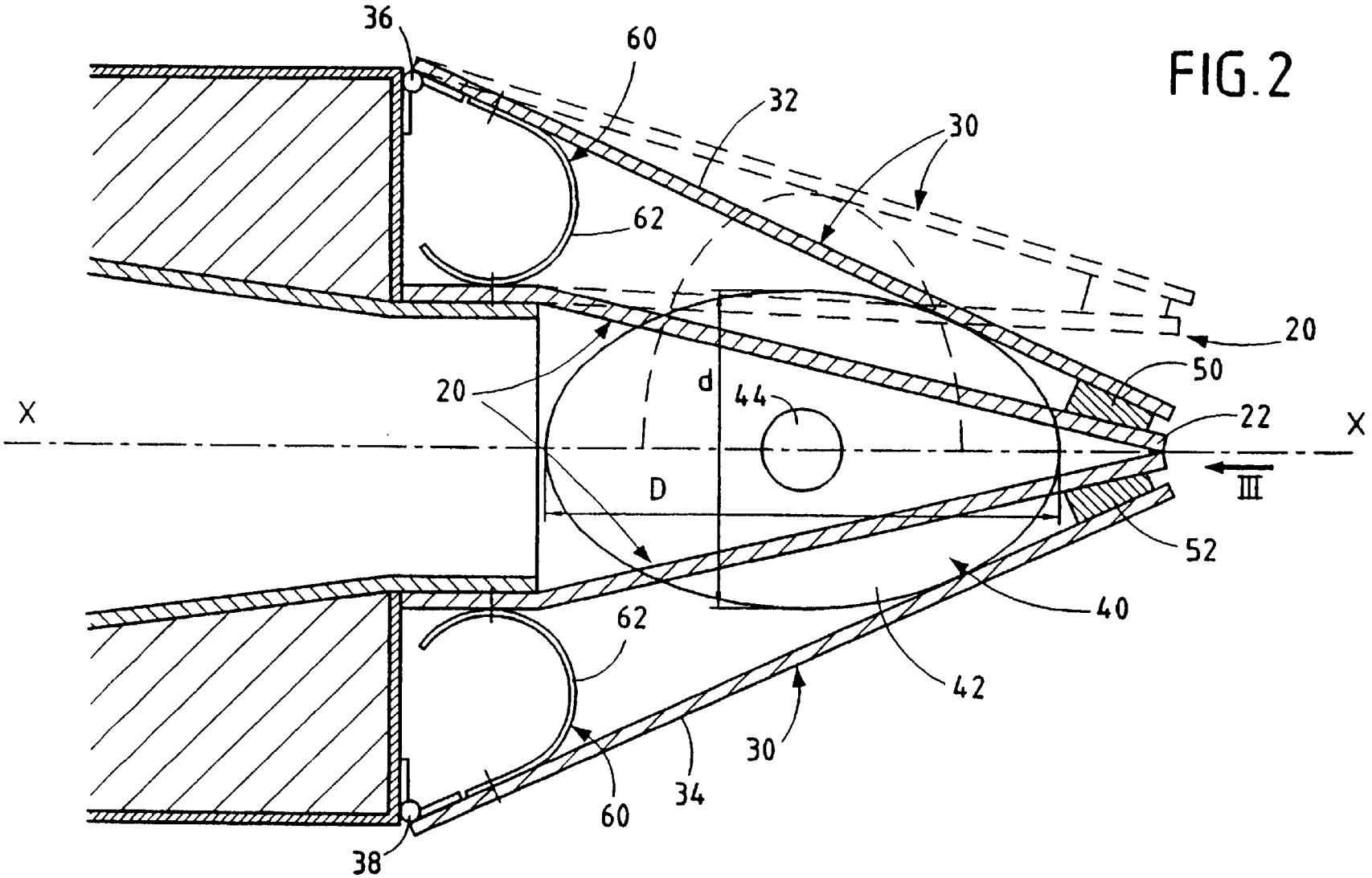
FIG. 2 is a fragmentary view on a larger scale of the zone II of FIG. 1, showing the maximum flow section position in dashed lines on one side only, and the minimum flow section position in continuous lines on both sides.
Figure 3:
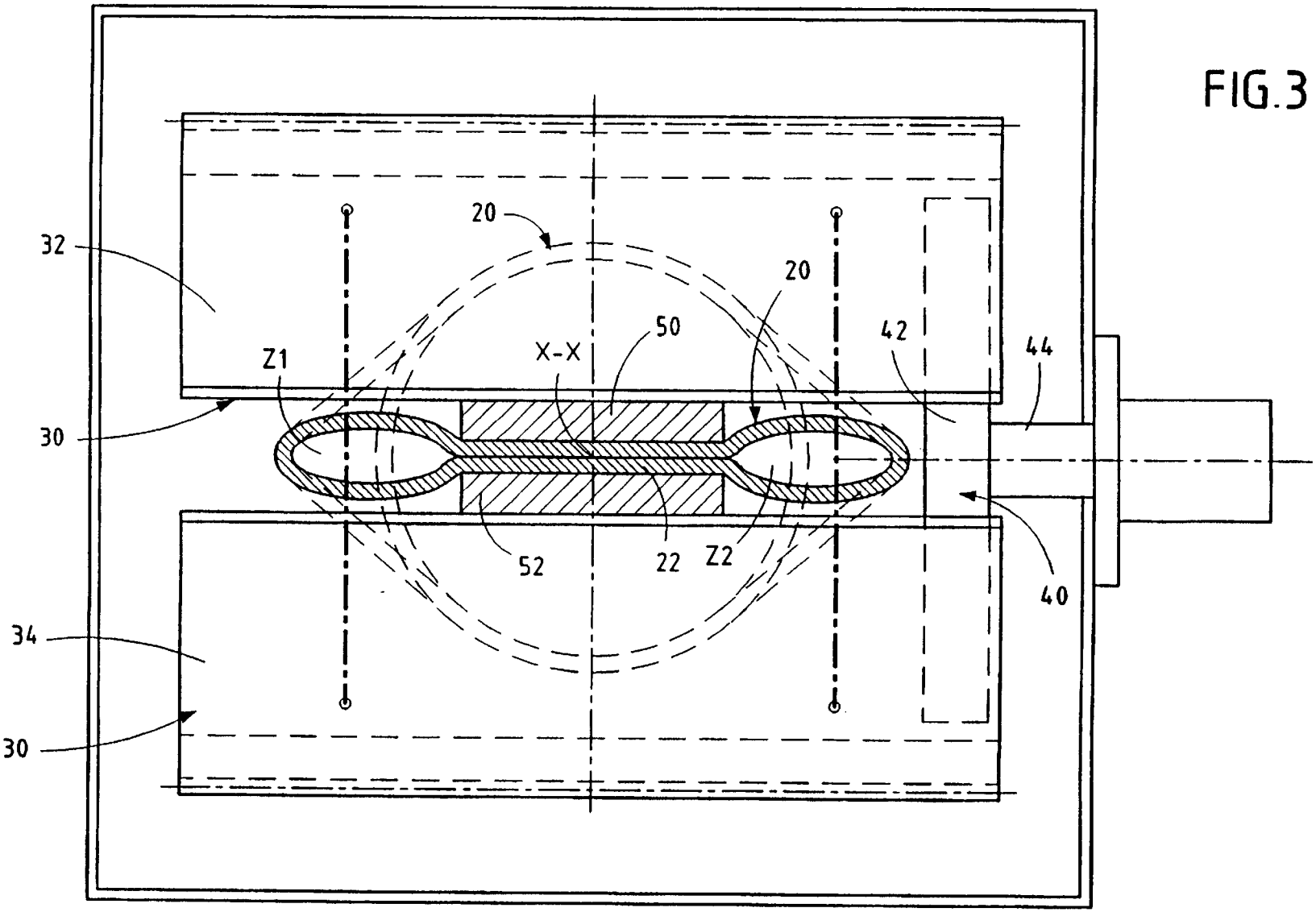
FIG. 3 is a downstream end view looking along arrow III of FIG. 2, with dashed lines showing the maximum flow section position and continuous lines showing the minimum flow section position.

The device 10 of the invention for compressing a compressible fluid 12 is characterized in that it comprises a deformable casing 20 that is circularly symmetrical in this example, and that is deformable between a maximum flow section (shown in FIG. 1, in part in dashed lines in FIG. 2, in dashed lines in FIG. 3, and in continuous lines in FIG. 4), and a minimum flow section (shown in continuous lines in FIG. 2, FIG. 3, and FIG. 6).

The deformable casing 20 thus makes it possible to increase the pressure of the air passing through said casing from a minimum pressure for the maximum flow section to a maximum pressure for the minimum flow section, as can be well understood by the person skilled in the art.

In an advantageous embodiment of the invention, the maximum flow section (shown in FIGS. 1, 4, and 7), of said deformable casing 20 is a substantially cylindrical section, which is also clearly visible in these figures.

In another embodiment of the invention, the maximum flow section of the casing 20 has a substantially flattened section.

In another embodiment of the invention, the device 10 is characterized in that it comprises means 30 for varying the section of said deformable casing 20.

In an advantageous variant embodiment, the means 30 for varying the section of the casing 20 are controlled by a control member 40 outside the casing 20, which member does not interfere with the flow section of the deformable casing 20.

The control member 40, visible at least in FIGS. 2 and 3, may, for example, comprise a cam 42, e.g. an elliptical cam defining a major diameter D and a minor diameter d and clearly visible in FIG. 2. The cam is mounted to rotate on an axle 44 disposed essentially perpendicularly to the plane defined by the elliptical cam 42, and is controlled by conventional rotary control means which are well known to the person skilled in the art, and which are thus not shown here, to make the figures easier to understand.

In another advantageous variant embodiment of the invention, the device 10 is characterized in that said deformable casing 20 comprises a diaphragm 22 which, in the non-deformed state (shown in FIGS. 1, 4, 7, and 8) has an essentially cylindrical shape, and which is made of rubber, elastomer or similar materials, for example.

In a particularly advantageous embodiment of the invention, the means 30 for varying the section of said deformable casing 20 comprise at least two flattening elements, respectively 32 and 34, clearly visible in the figures, and disposed substantially diametrically opposite about the axis X—X of symmetry (in particular shown in FIG. 2) of said circularly-symmetrical casing 20.

In a currently-preferred variant embodiment, each of the two elements 32, 34 comprises, in this embodiment, a substantially plane blade mounted to rotate about a pin 36, 38 (shown clearly in FIG. 2) substantially perpendicular to the axis of symmetry X—X of the circularly-symmetrical casing 20.

Advantageously, at their free ends for fluid outlet, the substantially plane blades comprise at least two wedge-forming elements 50, 52 of predetermined thickness and disposed diametrically opposite about said circularly-symmetrical casing 20, so that, at the end of the stroke, they close the circularly-symmetrical casing 20 in its central portion, as shown in continuous lines in FIG. 2 and FIG. 3, without leaving any gap over the distance defined by the wedge-forming elements 50, 52, as clearly visible in FIG. 3, but while leaving two open zones respectively referenced Z1 and Z2 in FIG. 3, offset from the axis of symmetry X—X so as to obtain a fluid flow rate at a maximum pressure. Naturally, the wedge-forming elements 50, 52 are not essential, and they may be removed if it is desired to obtain complete closure of the outlet opening, as can be advantageous in certain air-conditioning systems when a given room is to be isolated.

In another embodiment of the invention, said circularly-symmetrical casing 20 is of predetermined length which may advantageously be about twice its diameter.

It is also possible to provide an optional and deformable reinforcement element 54 (shown in particular in FIGS. 4 to 6) such as a metal grid around the circularly-symmetrical casing 20, thereby making it possible to limit the expansion of the circularly-symmetrical casing 20, constituted in practice by the diaphragm 22, when the fluid 12 passes under pressure inside said diaphragm.

Naturally, the means 30 for varying the section of the casing 20 (in this example, preferably comprising flattening elements 32, 34 in the form of substantially plane blades) are applied against the surface of the control member 40 (in this example, in the form of a wheel 42) by thrust means 60 on one side, such as springs 62, or some other equivalent means.

It can thus be understood that, with the invention, it is very easy to modify to the flow section of the deformable casing 20, merely by rotating the control member 40 by acting on the axle 44, as is also clearly visible by comparing FIGS. 8 and 9, respectively showing the maximum flow section and the minimum flow section.

In the context of the application of this fluid compressor device to apparatus 100 having a fluid jet that is preferably of constant range, said apparatus is characterized in the invention in that it comprises a confinement duct 110 in which said fluid 12 is confined, which is open at both of its ends, namely its upstream end 112 and its downstream end 114, and which is provided at its downstream end 114 with at least one device 10 of the present invention as described above.

In an advantageous embodiment, the apparatus 100 of the invention is characterized in that, at its upstream end 112, it comprises at least one member 120 organized to adjust the head loss of the incoming fluid.

In a currently-preferred embodiment, the member 120 for generating and adjusting a head loss comprises at least one cylinder, such as 122, 124, 126 (shown diagrammatically in FIG. 1, and shown more precisely in FIGS. 8 and 9), subdivided into a multitude of tubes, such as 130 (clearly visible in FIGS. 8 and 9), of predetermined diameter for passing said fluid, thereby making it possible to obtain head loss that is predetermined, while making said device 10 more flexible in use and increasing the amount whereby the downstream pressure can be varied.

Advantageously, the apparatus 100 of the invention is characterized in that, upstream, it comprises a plurality of, e.g. three, head-loss members, referenced 122, 124, and 126, that can be plugged into one another, as can be well understood by the person skilled in the art, so as to increase the total length of the tubes 130, thus varying the head loss, thereby influencing the value of the pressure of the fluid at the outlet of the apparatus 100, for a substantially constant pressure in the incident flow entering the apparatus.

In another advantageous embodiment of the invention, at least over a portion, said confinement duct 110 has an inside surface 140 of diameter tapering from upstream to downstream, so as to increase the speed at which the fluid flows.

FIG. 9 shows a possible modification of the head loss member 120, which modification is particularly advantageous in the context of large installations, in which it is desired to obtain accurate adjustment of head loss, which adjustment may be by way of an alternative to the adjustment obtained by varying the number of said disks 122, 124, 126, and may consist in providing at least one closure member 132 for closing off in part the active section of the head-loss member 120, which closure member is disposed upstream in this example, but may also be disposed downstream. The closure member 132 is advantageously disposed upstream so that adjustment is made easier, and it is mounted to be movable in translation substantially along the axis of symmetry (referenced X—X in FIG. 9) of the apparatus 100, e.g. by being secured to a threaded rod 133 co-operating with a nut-forming element 134 whose position is fixed. The partial-closure member 132 may have a maximum span or diameter D capable of closing off as much as about 50% of the intake area of the section S of the intake duct 102 for the flow, e.g. of air. It may be advantageous to streamline the upstream portion of the partial-closure member 132, e.g. as shown by imparting a frustoconical shape to it so as to create the least possible turbulence in the incoming upstream flow. It can be understood that when the member 132 is turned on the screw 133, the partial-closure member 132 is moved further towards or away from the first head-loss member 122, thereby making the closure member increasingly active or increasingly inactive as a function of the distance that separates it from the surface of the first head-loss member 122. In the limit, when the closure member 132 comes up against the surface of the first head-loss member 122, it closes off completely the orifices 130 disposed within its span. By means of this adjustment, it is possible to cause the flow rate to vary by 50%, and thus to adjust the head loss by a value in the range 1 to 4, as can be well understood by the person skilled in the art.

In the context of the apparatus of the invention 100 being used for air-conditioning at least one room, said apparatus is characterized in that it further comprises an injection system 150 for injecting a fluid 152 at a predetermined temperature for correcting the temperature or the humidity of said room, which system is preferably disposed outside the confinement pipe 110.

In an advantageous variant embodiment, said injection system 150 is disposed in the vicinity of the downstream outlet of said fluid 12, as shown in FIG. 1, preferably in a manner offset relative to the axis X—X of the circularly-symmetrical casing 20, as shown in FIG. 1.

In a currently-preferred embodiment, the injection system 150 comprises an additional fluid injection pipe 154 for injecting additional fluid 152 and whose diameter is approximately in the range two to four times smaller than the diameter of said circularly-symmetrical casing 20 in the non-deformed state which is shown in particular in FIGS. 4, 7, and 8.

In another embodiment, which may be advantageous in certain cases, injection system 154A may be disposed inside the confinement piping 110, in the vicinity of its upstream end.

In another advantageous embodiment of the apparatus of the invention 100, said confinement piping 110 may itself be disposed inside fluid feed ducting 160 for feeding fluid to said room.

Advantageously, the confinement piping 110 may be disposed inside said ducting 160 in the vicinity of a fluid intake inlet 162 for taking in fluid 12*a* from said room via suitable intake ducting 164, said intake preferably being performed by external mechanical means 166, such as a fan.

It can thus be understood that said fluid is preferably constituted by air, and said at least one room is located in business premises or in a dwelling.

Thus, by means of the invention it is possible to create a jet of fluid (preferably air) of substantially constant effectiveness for adjusting the heating or cooling power for heating or cooling a room, merely by modifying the air flow rate by modifying the downstream flow section for a fluid taken in at a substantially constant pressure upstream.

For example, it is known that, in order to adjust the temperature of a room in summer, it is customary to cause the flow rates of cold air to vary from 100% to 25%, and beyond this value, comfort becomes chancy since the low-speed cold air falls onto people, thereby generating drafts that are unpleasant for the user, even with quality blower outlets or with traditional induction systems.

In winter, the heating power is no longer adjusted by reducing the air flow rate. The flow rate is set to a stable value, and a thermostat adjusts a hot water flow rate or the power of an electrical battery of heat exchangers.

The invention makes it possible to cut heating or cooling power from 100% to 25% while reducing the downstream flow rate only slightly or by not more than about 25%.

In addition, the high induction ratios obtained make it possible to generate no cold or hot air drafts at low upstream flow rates because the air is blown out at a temperature in the vicinity of the temperature of the room, while achieving an improvement in the air trajectory which is situated outside the zone occupied by people, this trajectory being substantially horizontal, regardless of any change in flow rate obtained by increasing the pressure.

By means of the invention, the graph of upstream air flow rate and of downstream air flow rate as shown in FIG. 10 is obtained for the incoming fluid being at a pressure of 290 pascals. It can be observed that, if the upstream flow rate is varied from 100 $m^3$ per hour to 10 $m^3$ per hour, the downstream flow rate makes it possible to obtain a total flow rate that is still greater than 100 $m^3$ per hour, by reducing the outlet flow section of the fluid 12 delivered by the compressor device 10 of the invention, thereby making it possible to increase the induction ratio, under the influence of three factors, namely: firstly the rise in pressure and in speed at the outlet head, as the flow rate decreases, until the pressure of the fluid in the outlet has almost doubled; secondly the reduction in the volume of the jet of air 12 compressed inside the ducting 160, which reduction in volume releases an increasing amount of space for the induced air; and thirdly the fact that the contact perimeter of the induced air jet is maintained due to the fact that said deformable circularly-symmetrical casing 20 is flattened.

If it is desired to maintain the downstream flow rate of the apparatus for an upstream flow rate reduction of about 50%, the upstream head loss of the unit 120 is initially set to a maximum value so that, on reducing the upstream flow rate by 50%, the head-loss reduction corresponding to the flow-rate reduction of about 50% is to be found downstream, so that the pressure of the delivered flow is increased by a pressure value corresponding substantially to three-fourths of the head-loss difference obtained. For example, for an initial head loss in the upstream unit of 200 Pa and an outlet flow pressure value of about 200 Pa, if the flow rate is reduced by 50%, the upstream head loss becomes 50 Pa, and the headloss difference of 150 Pa is to be found substantially downstream at the diaphragm, so that the outlet pressure is maintained at about 350 Pa. In contrast, the incoming pressure of the flow remains unchanged at 400 Pa. It can thus be observed that, with the apparatus of the invention, and on the basis of an incident flow at substantially constant pressure, a variable pressure is obtained for the outgoing air flow.

As a result, it is possible to construct apparatus which, for a 50% reduction in flow rate, maintains an initial downstream flow rate that is unchanged.

The invention thus makes it possible to obtain a very comfortable air flow temperature because it can be very close to ambient temperature.

An example is given below.

Upstream air pressure:

upstream air flow temperature: 8° C.;

room temperature: 25° C.;

mixture temperature: 21.7° C.;

induction ratio: at least 5.14;

temperature difference relative to ambient: 3.3° C.;

upstream air flow rate: 36 $m^3$ per hour; and downstream air flow rate through the maximum flow section: about 185 $m^3$ per hour.

With a pressure reduction of about 80%, the downstream flow rate is equal to 140 $m^3$ per hour and the induction ratio goes to 7.7 for the minimum flow section of the circularly-symmetrical casing 20, whereas the flow section was previously at its maximum.

The temperature of the resulting mixture is expressed mathematically as follows:

$$\frac{(18\ m^3/h \times 8°\ C.) + (6.7 \times 18\ m^3/h \times 25°\ C.)}{7.7 \times 18\ m^3/h} = 22.8°\ C.$$

The temperature difference relative to ambient is 2.2° C., thus procuring a very good level of comfort.

Thus, the transfer device of the invention maintains an air range that is substantially constant, thereby making it possible for the air flow rate to be self-regulating or to be compensated automatically, so that there is no longer any need for pipes, pumps or heat-exchanger batteries for cooling or heating since all the necessary power can then be transmitted directly to the air or any equivalent fluid, so as to obtain comfort that is unparalleled.

It can be understood that the invention makes it possible to obtain decisive technical advantages that are mentioned above. The invention comprises all means constituting technical equivalents as well as their various combinations.

What is claimed is:

1. Apparatus for delivering a fluid jet of substantially constant range, comprising:

a) a confinement duct for confining a compressible fluid, which duct is open at both its upstream end and downstream end;

b) at its downstream end, at least one compressor device for compressing said fluid, which compressor device comprises a deformable casing that is deformable between a maximum flow section and a minimum flow section; and c) at its upstream end, said confinement duct comprises at least one head loss member constructed to adjust the head loss of the incoming fluid, thus increasing the pressure of the fluid passing through the casing from a minimum pressure for a maximum flow section to a maximum pressure for a minimum flow section, by modifying value of the pressure of the fluid at the outlet of the apparatus, and thereby providing a pressure in the fluid at the outlet of the apparatus that is variable starting from an incident flow of substantially constant pressure.

2. The apparatus of claim 1, wherein the head loss member comprises at least one cylinder subdivided into a multitude of tubes of predetermined diameter for passing said fluid, thereby making it possible to obtain head loss that is predetermined, while making said device more flexible for varying the pressure at the outlet.

3. The apparatus of claim 1, comprising a plurality of said head-loss members that can be plugged into one another, so as to increase the total length of the tubes, thus causing head loss to vary, thereby influencing the value of the pressure of the fluid at the outlet of the apparatus.

4. The apparatus of claim 1, wherein at least one partial-closure member is provided, upstream from said head loss member for adjusting the head loss of the incoming fluid, which partial-closure member can be moved between a position selected from the group consisting of an inactive position, a partially active position, a fully active position by being moved towards or away from the member for adjusting head loss, so as to provide fine head-loss adjustment.

5. The apparatus of claim 1, wherein said confinement duct has over at least a portion thereof, an inside surface of diameter tapering from upstream to downstream, so as to increase the speed at which the fluid flows.

6. The apparatus of claim 1, wherein said casing is circularly-symmetrical in shape, and its maximum flow section is a substantially cylindrical section and its minimum flow section advantageously has an essentially flattened section.

7. The apparatus of claim 1, further comprising means for varying the section of said deformable casing.

8. The apparatus of claim 7, wherein the means for varying the section of said casing are controlled by a control member outside the casing, which control member does not interfere with the flow section of the deformable casing.

9. The apparatus of claim 1, wherein said deformable casing comprises a diaphragm which, in the non-deformed state has an essentially cylindrical shape, and which is made of a material selected from the group consisting of a rubber, an elastomer, a thin metal and a thin blade.

10. The apparatus of claim 7, wherein said casing is circularly symmetrical in shape and the means for varying the section of said deformable casing comprise at least two flattening elements disposed substantially diametrically opposite about the axis of symmetry of said circularly-symmetrical casing.

11. The apparatus of claim 10, wherein each of said two elements comprises a substantially plane blade mounted to rotate about a pin substantially perpendicular to the axis of symmetry of said circularly-symmetrical casing.

12. The apparatus of claim 11, wherein the two substantially plane blades have free ends remote from said pin, said fee ends comprising at least two wedge-forming elements of predetermined thickness and being disposed diametrically opposite about said circularly-symmetrical casing, so that, when said casing is deformed at said minimum flow setting, said elements close the circularly-symmetrical casing in its central portion, while leaving two open zones offset from the axis of symmetry so as to obtain a fluid flow rate at a maximum pressure.

13. The apparatus of claim 1, wherein said deformable casing is of predetermined length which may be about twice its diameter.

14. Apparatus for air-conditioning at least one room, comprising at least one apparatus according to claim 1, and further an injection system for injecting a fluid at a predetermined temperature for correcting the temperature or the humidity of said room.

15. The apparatus of claim 14, wherein said injection system is disposed outside said confinement duct.

16. The apparatus of claim 14, wherein said deformable casing is circularly-symmetrical in shape and said injection system is disposed in the vicinity of the downstream outlet of said fluid, in a manner offset relative to the axis of said circularly-symmetrical casing.

17. The apparatus of claim 14, wherein the injection system comprises an additional fluid injection pipe for injecting additional fluid and whose diameter is approximately in the range two to four times smaller than the diameter of said deformable casing in the non-deformed state.

18. The apparatus of claim 14, wherein said injection system is disposed inside the confinement duct in the vicinity of its upstream end.

19. The apparatus of claim 14, wherein the confinement duct is itself disposed inside a fluid feed ducting for feeding fluid to said room.

20. The apparatus of claim 19, wherein the confinement duct is disposed inside said ducting in the vicinity of a fluid intake inlet for taking in fluid from said room, said intake being performed by external fluid feeding mechanical means.

21. The apparatus of claim 14, wherein said fluid is constituted by air, and said at least one room belongs to business premises or to a dwelling.

* * * * *